United States Patent [19]

Stahlecker

[11] Patent Number: 4,677,819

[45] Date of Patent: Jul. 7, 1987

[54] METHOD AND APPARATUS FOR OPERATING AN OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 841,936

[22] Filed: Mar. 20, 1986

[30] Foreign Application Priority Data

Mar. 22, 1985 [DE] Fed. Rep. of Germany ..... 3510512

[51] Int. Cl.[4] ..... D01H 13/22; D01H 13/32

[52] U.S. Cl. ..... 57/264; 57/265

[58] Field of Search ..... 57/22, 263, 264, 265, 57/93

[56] References Cited

U.S. PATENT DOCUMENTS

| | | | |
|---|---|---|---|
| 3,263,499 | 8/1966 | Gith et al. | 57/265 X |
| 3,667,292 | 6/1972 | Hada | 57/265 X |
| 3,878,671 | 4/1975 | Seidl et al. | 57/265 |
| 3,908,347 | 9/1975 | Vignon | 57/93 X |
| 4,015,414 | 4/1977 | Sholly | 57/264 |
| 4,084,398 | 4/1978 | Stahlecker | 57/264 X |
| 4,137,699 | 2/1979 | Stahlecker et al. | 57/264 |
| 4,418,525 | 12/1983 | Raasch | 57/264 |

FOREIGN PATENT DOCUMENTS 2944219 7/1980 Fed. Rep. of Germany .

*Primary Examiner*—Donald Watkins

*Attorney, Agent, or Firm*—Barnes & Thornburg

[57] ABSTRACT

A method and apparatus for operating an open-end friction spinning machine with a plurality of spinning units whereby yarn twist of yarn at the spinning units is monitored by a measuring and evaluating device. This monitored yarn twist is then compared with a predetermined desired yarn twist value. In response to deviations from the predetermined desired yarn twist, at least one parameter of spinning conditions is adjusted.

26 Claims, 8 Drawing Figures

METHOD AND APPARATUS FOR OPERATING AN OPEN-END FRICTION SPINNING MACHINE

BACKGROUND AND SUMMARY OF THE INVENTION

The invention relates to a method and apparatus for operating an open-end friction spinning machine having a plurality of spinning units. Each spinning unit includes a friction zone serving as a yarn forming point of region, a feeding and opening device for feeding the fibers to the friction zone, a suction device for holding the fibers and for forming yarn in the friction zone, and a withdrawal device for withdrawing the formed yarn out of the friction zone. The quality of the yarn spun at the spinning units is monitored by means of at least one measuring and evaluating device which triggers an adjusting of at least one parameter of the spinning conditions when there are deviations from the preset desired values of the yarn at the respective spinning unit.

A particular problem with one-end friction spinning is that it has been practically impossible to maintain the yarn quality of the formed yarn over longer periods of time. Differences in the yarn quality at the same spinning unit, as well as fluctuations of quality between yarns of different spinning units have been discovered from time to time. These quality differences are presumably primarily due to fluctuations in friction effect values within the friction zone over a course of time, which changes are difficult to exactly foresee. These fluctuations may be due to wear and tear or to accummulation of dirt particles upon the component parts forming the friction zone. Also, these fluctuations may be due to the characteristics of the fiber material and the spinning environment. For example, the spinning room humidity and temperature level and the amount of grease particles in the fibers being processed may affect the friction effect in the friction zone. In order to alleviate this problem, it has been proposed in accordance with pending commonly owned co-pending patent application Ser. No. 692,972, filed Jan. 22, 1985, to test the quality of the running yarn and upon detection of quality deviations or fluctuations, to accordingly change at least one parameter of the spinning conditions. In accordance with this proposal, a yarn tension sensor is arranged between a withdrawal device and the yarn forming region which monitors the yarn tension of the yarn for purposes of quality control. Conclusions can be drawn from changes in the yarn tension, regarding the quality and, for example, also regarding the applied yarn twist. At least one parameter of the spinning conditions may be changed upon undesirable deviations of the yarn tension in order to again return to the desired normal condition. This sort of indirect quality control of the formed yarn is easily realized and will also be sufficient in many instances. However, the danger does exist that this sort of quality control will no longer be sufficient under extreme circumstances, especially with high yarn withdrawal speeds and/or fine yarn numbers.

British Patent Specification No. 1,393,663 relates to an open-end rotor spinning machine and a device for measuring the count and twist factor of the material being spun. Although this arrangement utilizes the detection of the number of revolutions of a spinning rotor and the sliver feed and yarn withdrawal speeds to determine yarn twist in a rotor spinner, these are also indirect measurements of yarn twist. Because of the different operations of the yarn turning friction surface in rotor spinners and open-end friction spinning machines using friction rollers or the like, such indirect measurements of the twist would not work with precision friction spinning machines of the type contemplated by the present invention.

One object of the invention is to provide a method of permitting a precise quality control of the spun yarn and to accommodate a correspondingly slight change or adjustment of at least one parameter of the spinning conditions.

This object is achieved according to the invention by detecting the yarn twist of the yarn produced at the spinning units and monitoring the same by means of a measuring and evaluating device.

An important criteria for the quality check of the yarn is thereby the ability to monitor the yarn twist according to preferred embodiments of the present invention. It is also contemplated to additionally test for yarn uniformity and/or yarn stability in certain preferred embodiments of the invention. The detection of yarn twist is important because it facilitates immediate signaling of any deviations in the friction effect of the friction zone of the respective spinning unit so that measures can be directly taken to eliminate any fluctuations in the friction effect.

In certain advantageous preferred embodiments of the invention, it is provided to monitor the yarn twist of a running yarn produced in the spinning units. This monitoring function can be conducted by either a yarn testing device arranged at each spinning unit, or by a servicing apparatus equipped with such type of yarn testing device which is periodically assigned to all spinning units according to certain embodiments of the invention. The first embodiments offer the advantage of a continuous monitoring, while the second embodiments advantageously keep operational expenditures to a minimum.

In a further development of preferred embodiments of the invention, it is provided to insert the yarn being monitored at a spinning unit into a movable servicing apparatus and to feed the same to a measuring device. This development takes into account that it becomes increasingly difficult to monitor the yarn twist in a yarn running with high production speeds. However, if the yarn is inserted into a movable servicing apparatus, its yarn twist can then be measured accordingly while the same runs very slowly or stands still all together. The arrangements necessary for this procedure need only be provided once per spinning machine, thereby keeping the operational costs in bearable limits.

In a further development of certain preferred embodiments of the invention, it is provided to continue the operation of the spinning unit during measurement. The yarn running through the servicing apparatus and produced during this measurement is returned to the spinning unit upon completion of the task and is wound upon a take-up spool of same. In these embodiments, the measuring of the yarn twist and the required adjusting of the spinning unit are accomplished without interrupting the yarn production of the respective spinning unit. These arrangements require a storage device to be provided in the servicing apparatus which safely accommodates the yarn continually produced during the measurement, and which allows subsequent withdrawal of the yarn out of the storage device.

In another embodiment of the invention, it is provided to discontinue the operation of the spinning unit upon insertion of the yarn into the servicing apparatus, and upon the removal of a yarn test sample, to peform a piecing operation at the spinning unit. Because a servicing apparatus capable of performing a piecing process is generally contemplated for commercial friction spinning machines, this method can be accomplished relatively inexpensively.

In another development of preferred embodiments of the invention, it is provided to obtain a yarn test sample for measuring the yarn twist from a take-up spool of a non-operating spinning unit. This would further reduce the expense for any necessary equipment for removing a yarn sample, because a servicing apparatus can at least in part be utilized also which is commonly used for performing a piecing process. In this embodiment, it is also advantageous to remove a yarn sample from the take-up spool during a piercing process at this spinning unit. Then, in one working step, this servicing apparatus can accomplish not only the piecing, but also the measurement of the yarn twist, and additionally, as the need arises, attend to the adjustments of one or serveral parameters of the spinning conditions which are determined to be desired based on the measurement of the yarn twist.

In a further development of preferred embodiments of the invnetion, it is provided that the servicing apparatus establishes conditions at a particular spinning unit during the testing of the yarn twist prior to changing any parameters of the the actual value of one or several parameters of the spinning conditions thereof, and utilizes this actual value in the measuring and evaluating device. The possibility is thereby created to have the measuring and evaluating device determine which of the parameters are best to be adjusted for obtaining the desired results.

In a further development of preferred embodiments of the invention, it is provided that the measuring and evaluating device of the servicing apparatus compare the measured actual value to the preset limiting values of the parameters of the spinning conditions with regard to any necessary adjustments based upon the measured yarn twist. Further, the measuring and evaluating device discontinues operation of the spinning unit when values exceed the limiting values and/or marks the spinning unit that requires service. Prior to restarting the spinning unit and continuing of yarn production, the necessary service tasks are performed such as a cleaning process or treating or processing the surfaces of the friction zone at this spinning unit. These servicing tasks put the servicing apparatus into a position to meet the required spinning conditions.

In a further development of preferred embodiments of the invention, it is provided that the measuring and evaluating device of the servicing apparatus compares the measured actual value of the parameters of the spinning conditions with the preset limiting values of the parameters, in consideration of the necessary changes based upon the measured yarn twist. In addition, certain preferred embodiments include devices for assigning means for cleaning and/or post-treatment, especially of the friction zone, to the respective spinning unit requiring adjustment after having exceeded the limiting values. This part of the maintenance of the spinning unit is thereby also fully automated.

Further objects, features, and advantages of the present invention will become more apparent from the following description when taken with the accompanying drawings, which show for purposes of illustration only, several embodiments constructed in accordance with the present invention.

DETAILED DESCRIPTION OF THE DRAWINGS

Figure 1:
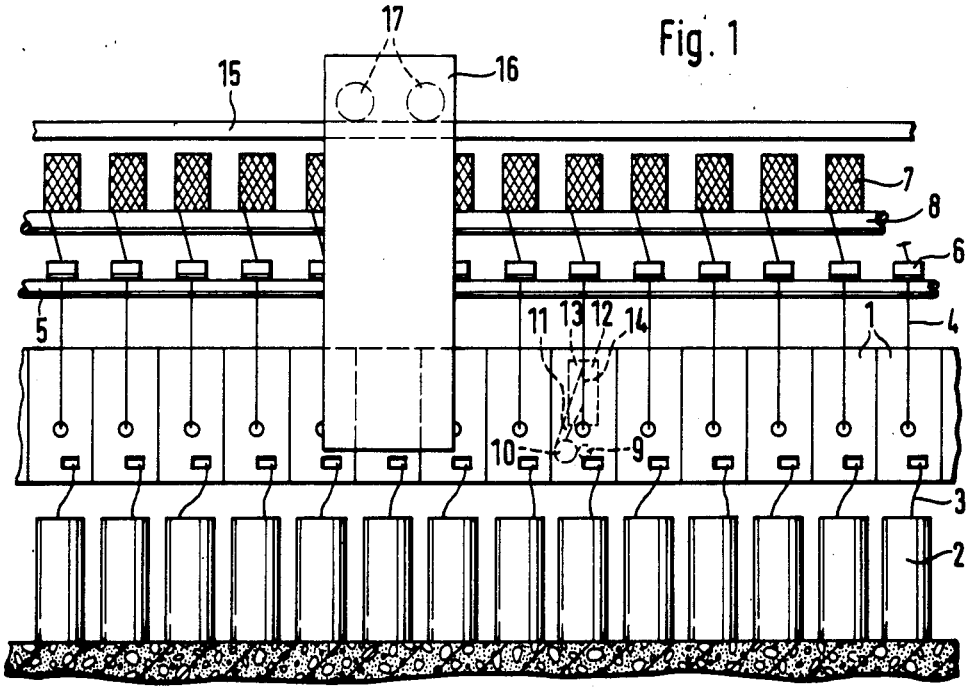
FIG. 1 is a schematic partial front view of an open-end friction spinning machine having a movable servicing apparatus, constructed in accordance with preferred embodiments of the present invention.

The open-end friction spinning machine according to FIG. 1 includes a plurality of similarly configured spinning units 1 that are arranged next to one another in a row. Each machine side is preferably provided with a row of spinning units 1.

Each spinning unit 1 is supplied a fiber band or sliver 3 out of a fiber sliver container 2 which is spun into yarn 4 in the spinning unit 1. The yarn 4 is withdrawn by means of a withdrawal device including a drivable lower shaft 5 running through in longitudinal direction of the machine, and a pressure roller 6 assigned respectively to each spinning unit 1. The withdrawn yarn 5 is subsequently wound onto a winding spool 7 whereby all winding spools 7 are driven by a drivable winding roller 8 running through in longitudinal direction of the machine.

As is shown in FIG. 1 only at a single spinning unit 1, each spinning unit is provided with a feeding roller 9 which cooperates with a feeding table retrieving the fiber sliver 3 out of a fiber sliver container 2 and drawing the same into the spinning unit 1. The feeding roller 9 offers the fiber sliver 3 to a faster rotating opening roller 10 which opens it into single fibers. The single fibers are fed via a fiber feeding duct 11 to the friction zone formed as a wedge-shaped gap 14 between two adjacently arranged rollers 12 and 13 driven in the same rotational direction. the formed yarn 4 is withdrawn in the longitudinal direction of gap 14.

Figure 2:
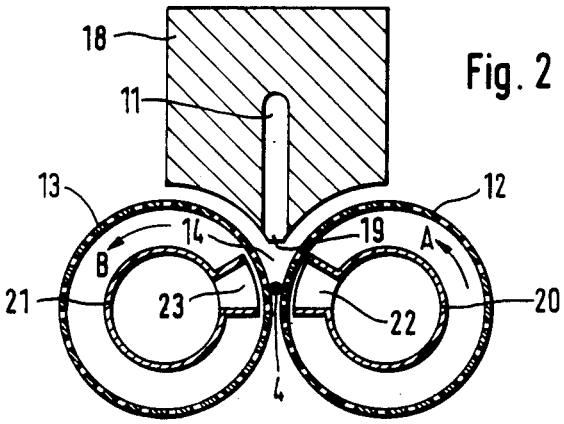
FIG. 2 is an enlarged cross-sectional view through a spinning unit of the open-end friction spinning machine of FIG. 1, in the area of the friction zone of one of the spinning units.
Figure 3:
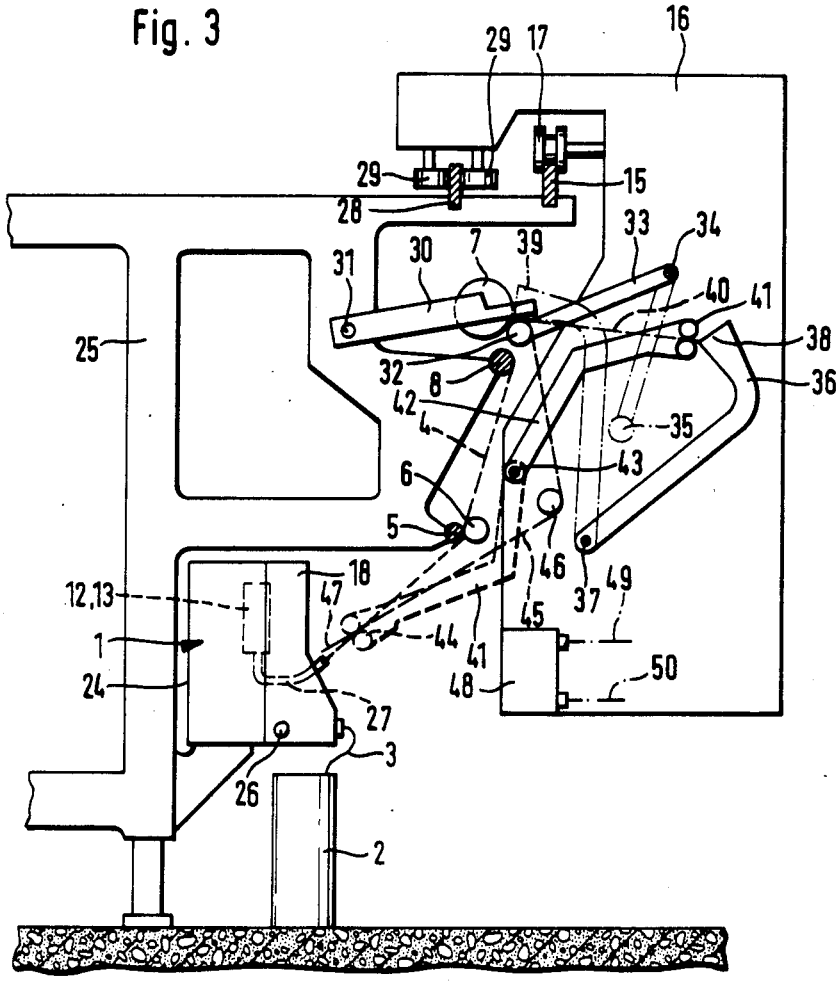
FIG. 3 is a schematic side view of a spinning unit and a schematical depiction of a servicing apparatus of the machine of FIG. 1.
Figure 4:
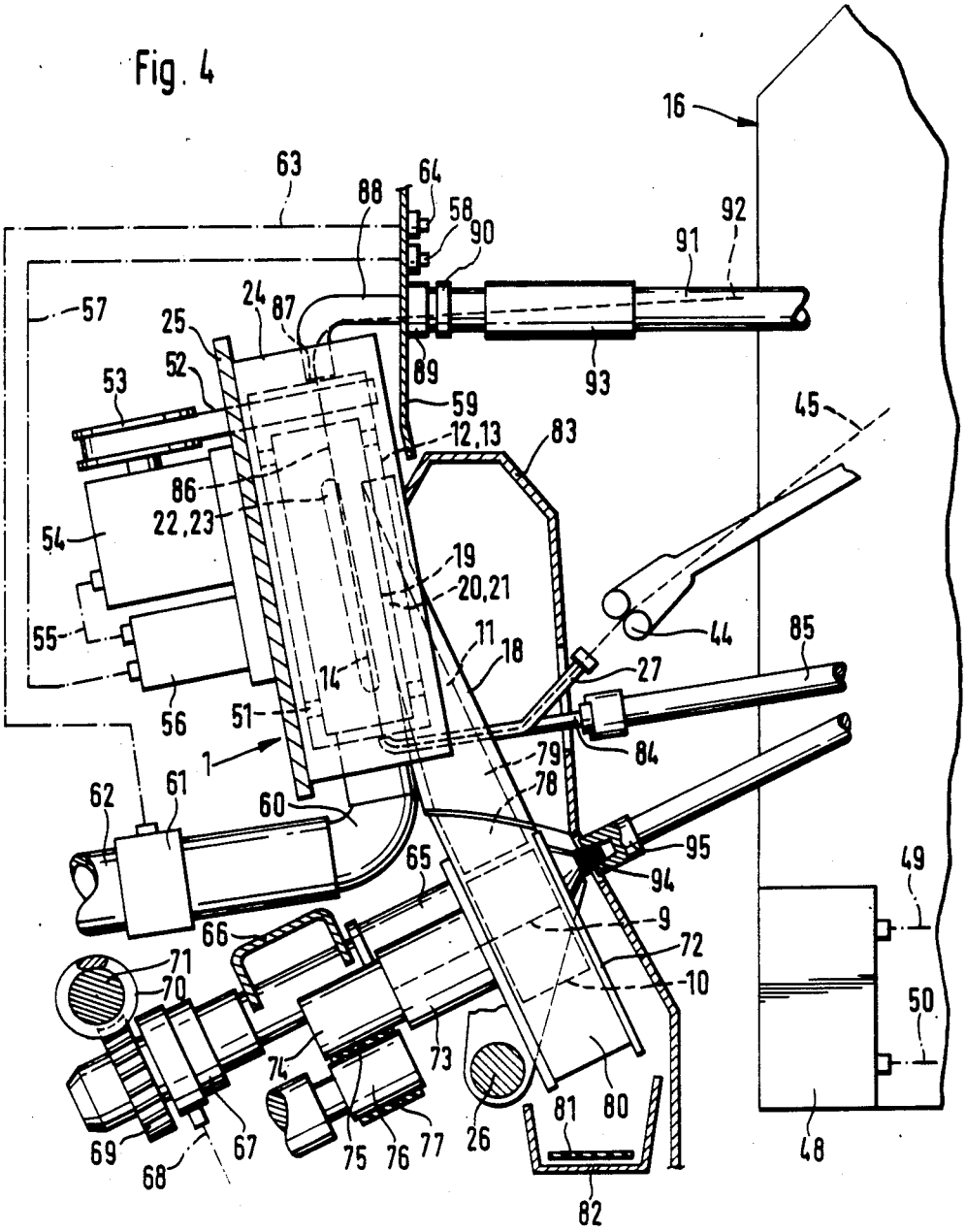
FIG. 4 is an enlarged cut-out sectional view of portions of the spinning unit and the servicing apparatus according to FIG. 3.

Further details of the spinning units 1 are shown in FIGS. 2 to 4. The rollers 12 and 13 are configured as cylindrical sleeves directly borne by means of roller bearings 51 upon pipes 20 and 21. Pipes 20 and 21 are connected via a connecting piece 60 and a control valve 61 to a suction line 62 which is connected to a channel running through in the machine longitudinal direction and having a vacuum source assigned at its end. Pipes 20 and 21, located within rollers 12 and 13 and closed at the ends opposite the connecting piece 60, include suction slots 22 and 23 delimited by webs projecting up close to closely adjacent the inside surfaces of rollers 12 and 13. The suction slots 22 and 23 are directed towards the area of the wedge-shaped gap 14. the shells or covers of rollers 12 and 13 are provided with perforations, at least in the area of the suction slots 22 and 23, thereby accommodating sucking in of a suction air current penetrating the shells of rollers 12 and 13.

The suction air current generated via the suction slots 22 and 23 of pipes 20 and 21 serves to retain the forming yarn in gap 14 and to feed fibers via the fiber feeding duct 11. The fiber feeding duct 11 is located in a duct housing 18 and extends with a slot-like mouth 19 essentially parallel to and at a narrow distance to the wedge-shaped gap 14.

The feeding roller 9 and the opening roller 10 are located underneath rollers 12 and 13 (FIG. 4). The feeding roller 9 of a spinning unit 1 is borne at a pipe 65 fixedly attached to a fastening element 66 stationarily attached to the machine. The shaft of feeding roller 9 includes an electromagnetic coupling 67 connected via an electrical line 68 to a yarn beakage guard, not shown, which monitors the existence of the yarn 4. Upon detection of breakage of a yarn 4 by the yarn breakage guard, the electromagnetic coupling 67 is opened, thereby separating the shaft of the feeding roller 9 from the toothed wheel 69 arranged thereupon. The toothed wheel 69, together with a toothed wheel 70 arranged upon a driven shaft 71 and running through in longitudinal direction of the machine effects the drive of the feeding roller 9.

The opening roller 10 is arranged in an opening roller housing 72 including a sleeve-type extension 73 which carries the shaft 74 of the opening roller 10. Shaft 74 of the opening roller 10 protrudes out of this extension 73 and is driven by means of a tangential belt 75 running through in the longitudinal direction of the machine. The tangential belt 75 is loaded in the area of each shank 74, with a respective tensioning roller 76 upon which the return driven drum 77 of the tangential belt 75 is guided. A dirt separator opening 80 is provided in the opening roller housing 72, underneath the opening roller 10 which opening 80 segregates dirt particles out of the combed fiber sliver 3. These particles reach a dirt removal conveyor 81 guided in a trough-like guidance element 82 in the longitudinal direction of the machine. The opening roller housing 72 contains a first segment 78 of the fiber feeding duct 11, which continues in a second segment 79 that is provided in duct housing 18. The duct housing 18 is attached to a machine frame cover 83 which is part of the spinning unit 1 and which is pivotable together with the duct housing 18 around axis 26 located below the feeding roller 9 and the opening roller 10, for exposing the area of rollers 12 and 13.

The two rollers 12 and 13 are driven in the same rotational direction (arrow direction A and B in FIG. 2) via a drive belt 52 driven directly against their shell surfaces. The drive belt in turn is driven by a driving disc 53 attached to an electric motor 54 fixedly attached to a machine carrier part 26. Each spinning unit 1 is thereby arranged with its own individual electric motor 54 for driving rollers 12 and 13. The drive motor 54 is connected via an electric line 55 to a control unit 56 that adjusts the speed of the electric motor 54 to suitable values.

The yarn 4 is withdrawn in a direction from above to below the rollers 12, 13 which is opposite to the feeding direction of the fibers from below to above. An adjustable yarn withdrawal pipe 27 is arranged in the extension of the wedge-shaped gap 14. This yarn withdrawal pipe 27 guides the finished yarn out of the spinning unit 1 and diverts the same upwardly towards the withdrawal device 5, 6 (FIG. 3).

Each of the spinning units 1, shown and described here, offers the possibility to individually adjust several parameters of the spinning conditions for obtaining an optimum total effect. The electric motors 54 of each spinning unit 1 can be controlled to a desired speed via control unit 56. The control unit 56 is provided via line 57 with an adjusting switch 58 arranged at the outside of a machine frame cover 59. The desired rotational speed of the electric motor 54 can be adjusted, and the electric motor 54 is switched on and switched off thereby. The electrovalve 61 is connected via an electrical line 63 to a regulator switch 64 also fixedly attached at the machine frame cover 59. This switch 64 adjusts the desired opening position of the electrovalve 61 by means of which is regulated a defined vacuum pressure in the area of the wedge-shaped gap and thereby a defined vacuum air current. At the same time switch 64 is configured such that the electrovalve 61 can be completely closed thereby. A further possibility for an adjustment is offered by the yarn withdrawal pipe 27 which is adjustable in such a manner that the relative position of its entrance to the wedge-shaped gap 14 can be changed. By adjusting this entrance, the length of the yarn within the wedge-shaped gap 14 is set within which this yarn is thereby exposed to the friction effect. Furthermore, suction pipes 20 and 21 are adjustable axially and in circumferential direction allowing the adjustment of their relative position with respect to the wedge-shaped gap and to the opening 19 of the fiber feeding duct 11, and thereby permitting proportioning the suction effect upon the forming yarn and the resulting friction effect in the wedge-shaped gap 14. Additionally, it is contemplated to also adjust the opening cross sections of the suction slots 22 and 23.

All of the above-indicated parameters of spinning conditions influence the friction effect upon the forming yarn 4 and thereby the yarn twist received by the yarn 4. This yarn twist is measured and monitored as is described in detail below. Depending upon these measuring and monitoring results, the parameters are changed accordingly as deviations of the preset desired values are detected which are crucial for the friction effect and thereby for the introduced yarn twist. For simplicity purposes, the following only discusses regulation of the friction effect in adjusting switches 58 and 64 by means of adjusting the rotational speed of the electric motors 54 and thereby of rollers 12 and 13, and also by adjusting the electrovalve 61. Other means are also contemplated by the invention which simultaneously or separately change the above-indicated other parameters of the spinning conditions. The embodiments described in FIGS. 3 and 4 show the yarn twist of the forming yarn 4 in connection with correcting a yarn breakage. It can here be provided that these tasks are performed in connection with either an inadvertently occurring yarn breakage, or an intentionally produced yarn breakage which occurs at certain predetermined time intervals.

The piecing process and also the measuring of the yarn twist, as well as, if necessary, adjustments in the spinning parameters are conducted by the movable servicing apparatus 16. The servicing apparatus is movable on rails 15 by means of running wheels 17 of which at least one is driven, and is supported against rails 28 by means of contact rollers 29. Rails 15 and guide rails 28 are attached above the spinning unit 1 and the take-up spool 7 at the machine frame 25. During a yarn breakage, the take-up speed 7 of the respective spinning unit 1 lifts off the winding roller 8. The take-up spool 7 is supported in a spool frame 30 pivotable about an axis 31 and is assigned an auxiliary winding roller 32 arranged upon lever 33 pivotable about an axis 34 of the servicing apparatus 16. The auxiliary winding roller 32 is rotatable in both rotational directions and is pivotable in a range between the dotted-line position 35 and the position shown in solid lines. A yarn detector nozzle 36 is further assigned to the lifted take-up spool 7 and is pivotable about an axis 37 of the servicing apparatus 16 into position 39 indicated in dotted lines. Subsequently thereto, the take-up spool 7 is driven by means of the auxiliary winding roller 32 in uncoiling direction, thereby sucking the unwound yarn into mouth 38 of the yarn detector nozzle 36. The nozzle 36 is then returned from its extended position. A yarn end 40, indicated in dotted lines, is stretched between the auxiliary winding roller 32 and the mouth 38 of the yarn detector nozzle 36. A clamping roller pair 41 originally in a moved-apart position is assigned to this yarn piece 40 and is closed upon clamping the yarn in between the rollers 41. The pair of clamping rollers 41 are also drivable in both rotational directions. The rollers 41 are arranged on a lever 42 pivotable about an axis 43 of the servicing apparatus 16 into a position 44, indicated in dotted lines, located opposite the exit opening of the yarn withdrawal channel 27. In this position, a thread end 47 is made available. This thread end 47 is produced by means of a splicing apparatus located in the area of the mouth of the yarn detector nozzle 36. The auxiliary winding roller 32 is driven in an unwinding direction during the movement of the pair of clamping rollers 41 into position 44. During this open pivot movement, the yarn is positioned over a thread guide 46 into position 45, indicated in dotted lines.

The yarn end 47 is introduced into the spinning unit 1 by further unwinding the yarn off the take-up spool 7 by driving the auxiliary winding roller 32 in unwinding direction, and by simultaneously driving the pair of clamping rollers 41 in unwinding direction, as can be seen in more detail in FIG. 4. As shown in FIG. 4, a junction 84 connects the yarn withdrawal pipe 27 in the area of its upwardly directed connecting piece and this junction is assigned a compressed air source line 85 of the servicing apparatus 16. An air current is produced by blowing pressurized air into the area of the exit of the yarn withdrawal pipe 27 where yarn end 47 is taken on. The entering yarn end 47 is blown in over the area of the wedge-shaped gap 14, against the normal withdrawal direction, by the entrance opening of the yarn withdrawal pipe 27 acting as blowing nozzle. The yarn end 47 is received by the mouth 87 of a suction pipe 88 arranged at the opposite end of the wedge-shaped gap 14. This suction pipe 88 includes a connector 89 attached at the machine frame cover 59 and is coupled to a connector 90 of a suction duct 91 of the servicing apparatus 16. During this return of the yarn end 47, now positioned with its end 92 in the suction duct 91, the servicing apparatus 16 switches off both the vacuum in the suction slots 22 and 23 and the electric motor 54 via control switches 58 and 64. A device 93 is arranged in the suction duct 91 of the servicing apparatus 16, which measures the twist of the yarn as is more clearly described later in connection with FIGS. 5 and 6. After the return of the yarn, the same is prepared by fraying or otherwise treating the end for accommodating piecing whereupon the servicing apparatus 16 activates the actual piecing process. For this purpose, the servicing apparatus 16 again switches on the subpressure in the suction slots 22 and 23, as well as the electric motor 54. The servicing apparatus 16 also includes an auxiliary drive 95 which is assigned during the yarn piecing process to a toothed wheel 94 of the opening roller 9 accessible from the outside. This auxiliary drive controls the fiber feeding process until the running yarn, shown in FIG. 3 in a dotted line, has again closed the coupling 67 via the yarn breakage guard. During this piecing process, the pair of clamping rollers 41 located in the position 44 draw off the pieced yarn that is then wound upon take-up spool 7 by means of the auxiliary winding roller 32.

Figure 5:
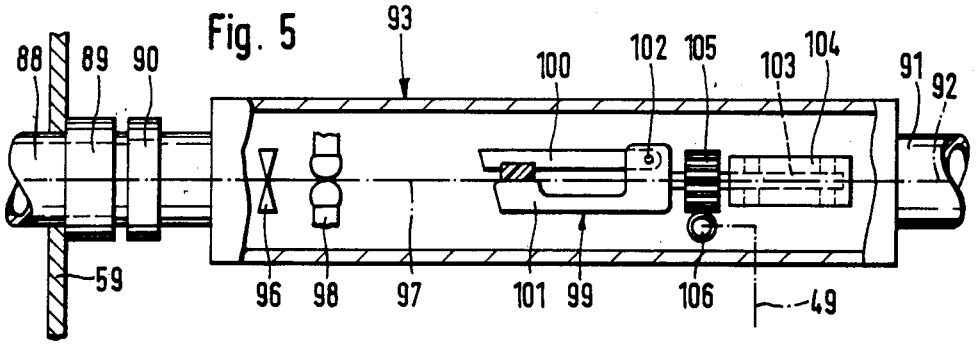
FIG. 5 is a side sectional view of a mechanical untwisting arrangement from FIG. 4 for determining the yarn twist of a yarn sample.

The device as shown in FIG. 5 for measuring the yarn twist (described below) is arranged in a different location with another embodiment of the invention, more particularly in the area of the yarn detector nozzle 36. In this case, the yarn end separated prior to the return of the yarn into the spinning unit 1, is examined with respect to its twist.

Referring to FIG. 5, the arrangement 93 includes a shearing or cutting device 96 at the area of its entrance that cuts off the yarn end 97 for conducting the subsequent further steps of the piecing process unimpeded by the yarn testing. The yarn piece end portion 97 to be tested is held at one end by means of a stationary yarn clamp 98. The other end is held in a yarn clamp 99 formed with tong like clamping parts 100, 101. One half 100 of the tong-like clamp is movable about a pivot axis 102 against the other half 101. The yarn piece 97 is picked up by yarn clamp 99 while it is still under tension by the suction duct 91. Yarn clamp 99 is pivotably borne upon a shaft 103 in a bearing housing 104. The shaft is provided with a toothed wheel 105 engaging into a driven toothed wheel 106. The yarn piece 97 is then wound up against its normal spinning rotation whereby the number of rotations required therefore is counted and transmitted via an electrical line 49 to an evaluating device 47 (FIG. 4) of the servicing apparatus 16.

This evaluating device 48 in turn is connected via one or several lines 50 to devices that adjust, especially via control switches 58 and 64, one or several parameters of the spinning conditions upon detection of deviations from the desired yarn twist. The servicing apparatus 16 prior to adjusting the parameters of the spinning conditions, first checks the respective actual values and the evaluating device 48 takes these signals into account for a determination as to whether and which parameter to adjust. Such examination is conducted, in a simple manner, by having the servicing apparatus 16 with its control means also check the respective position of the control switches 58 and 64 to be inputted as signals into the evaluation device 48, since the respective position of the control switches 58 and 64 constitute an indication for the respective adjustment.

It is also contemplated in certain preferred embodiments of the invention to conduct a direct check of the respective parameters and recall the same by means of the servicing apparatus 16. For example, each electric motor 54 is assigned a speed signal transmitter which value is recalled by the servicing apparatus 16. Vacuum transmitters may be arranged in the pipes 20 and 21, in a corresponding manner, which are also recalled by the servicing apparatus 16. In the event the evaluating device 48 determines that a further adjustment of one or several parameters is no longer possible in the direction required to obtain the correct yarn twist, it is then provided in an embodiment which is not further described here, to discontinue the operation of the corresponding spinning unit and to mark the same as being unable to perform a piecing process if a servicing is not conducted first for restoring the spinning parameters. With still another embodiment, it is provided to equip the servicing apparatus 16 with means for automatically conducting a pretreatment of the spinning unit 1 for reinstating the actual values of the spinning parameters, for example, by way of cleaning and/or pretreatment of the friction zones. Such an arrangement is, for example, shown in FIG. 8 which will be discussed further below.

The measured values of the yarn twist are inputted into the evaluating device 48 and compared to stored values of a correctly twisted yarn. There are admissible tolerance ranges provided which, once exceeded, trigger the appropriate working steps for adjusting one or several parameters of the spinning conditions.

Figure 6:
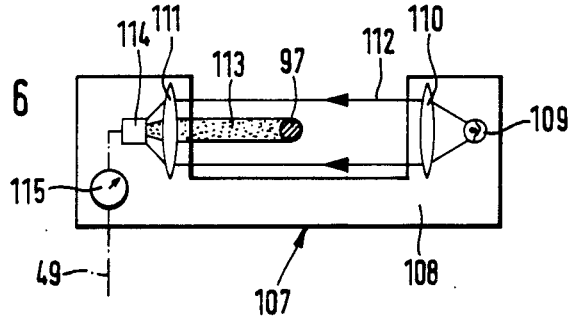
FIG. 6 is a side cross-sectional view of an optical device for monitoring a yarn sample, constructed in accordance with another preferred embodiment of the invention.

A number of options are provided for measuring the twist existing in the yarn, for example, mechanical, electrical, or optical means. An embodiment is shown in FIG. 6 which is provided with an optic-electrical measuring device 107. A light source 109 is arranged in a housing 108 whereby a yarn piece 97 to be examined is located between a light source optic and a receiver optic. Following the receiver optic, the light rays 112 are transmitted to a photodiode 114 connected to a measuring device 115 which in turn is connected via electrical line 49 to the evaluating device 48 of the servicing apparatus 16. A shadow 113 that corresponds to the diameter of the yarn piece 97 is projected upon the receiver optic. An evaluation regarding the yarn twist is made possible with the deivce if the fiber number is known. The fiber number itself can furthermore be determined by, for example, additionally providing an electrical device, namely a capacitance measuring device (capacitor). With a combination of these deivces, it is possible to determine the yarn twist especially in a running yarn.

In another embodiment, it is contemplated to twist the slowly running or still-standing yarn, for example, with an arrangement according to FIG. 5 which monitors the form changes occurring thereby, namely the cross-sectional enlargement or decrease, by means of, for example, a device according to FIG. 6. The form change being dependent upon the twist, especially during a counter-clockwise rotation against the pre-existing spinning rotation, is an explicit indication of the pre-existing yarn twist. In another embodiment, an air vortex is provided as a twisting device that is produced by a twist nozzle or jet. Other embodiments monitor the behavior of the yarn during deformation, for example, during bending or shoving (compression loading) or the like, which in each instance is different depending upon the existing yarn twist in the yarn. By comparing these measurements to the behavior of a yarn exhibiting the desired yarn twist, one can then in each instance make a determination as to whether the measured yarn twist is within the permissible tolerance range or has already exceeded the same.

The embodiment according to FIGS. 4 and 5 provides that the measurement of the yarn twist is conducted by removal of a yarn sample during shut down of spinning unit 1. Since this yarn test is conducted at the end of the yarn having been returned into the spinning unit 1, one need not wait for the results of the measurement for a restarting spinning process. For example, it may be provided to conduct this measurement subsequent to the piecing while the servicing apparatus 16 has already commenced its monitoring travel. In this instance, and if it becomes a necessity, the required changes in the parameters of the spinning conditions are conducted by the servicing apparatus during its next round.

In another embodiment, it is provided to measure the yarn twist of the running yarn. With the embodiment according to FIG. 7, the servicing apparatus 116 includes a corresponding yarn testing device 107 arranged upon a lever 119. This device 107 on lever 119 is assigned to the running yarn located between the yarn withdrawal pipe 27 and withdrawal rollers 5, 6. Lever 119 is pivotally supported at an axle 120 of the servicing apparatus 116 and is moveably controlled by means of an engaging element 121, 122 acting against the effects of a spring 123. In this case, the necessary adjustments of the parameters of the spinning conditions are then conducted while the spinning unit is operational and continues the yarn production. The yarn testing apparatus 107, in this instance, also monitors the performance of the adjustments made with respect to one or several spinning parameters in connection with the evaluating device 48.

Figure 7:
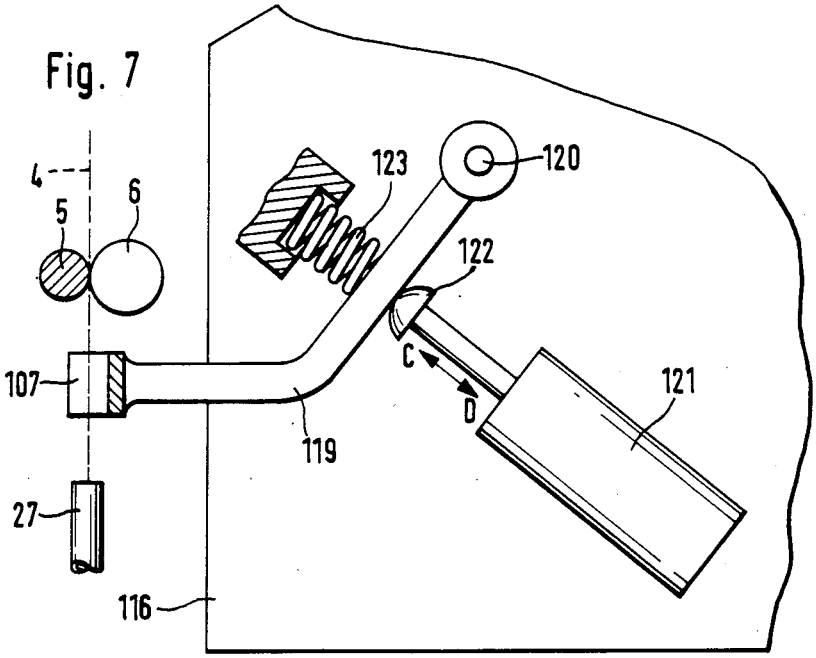
FIG. 7 is a partial schematical, sectional view of a movable servicing apparatus including a yarn testing device adjustable to a spinning position with running yarn constructed in accordance with certain preferred embodiments of the invention.

In a modification of the embodiment according to FIG. 7, it is provided to equip each spinning unit 1 with a stationarily arranged yarn testing device 107 which performs a continuous monitoring of the running yarn. This yarn testing device, in a first embodiment, is connected to a central evaluating unit of the open end friction spinning machine. In another embodiment of this kind it is provided that the yarn testing device 107 is monitored during travel by an adjustable device of the servicing apparatus 116.

In an embodiment not shown here, it is provided to equip the servicing apparatus 16 with elements to obtain a yarn sample out of the running production of a spinning unit for exposing the same to a yarn twist mesurement. In this case, the servicing apparatus 16 includes an arrangement for lifting off the take-up spool 7 from the winding roller 8, more particularly off an auxiliary winding roller 32. The yarn being further drawn out of the spinning unit by means of the withdrawal device 5, 6 is introduced into the servicing apparatus 16 and stored there temporarily. At this point, it is possible to stop a yarn piece or to allow only slow motion in order to conduct the measurement of the yarn twist. Upon completion of the yarn twist measurement, the yarn is then returned to the spinning unit 1 whereby the take-up spool is first driven with an increased rotational speed by the servicing apparatus 16 until the yarn length produced during the work conducted is again withdrawn out of the servicing apparatus 16. In this embodiment, a changing of the spinning parameters by the servicing apparatus 16 is also conducted without shut down of a spinning unit 1.

In another embodiment not shown here, it is provided that the servicing apparatus receives the running yarn in front of the take-up spool 7, separates it there, and allows the continuously forming yarn to pass into the servicing apparatus. The spinning unit discontinues operation upon having received a sufficiently long enough yarn piece for conducting the yarn twist measurement. After a necessary adjustment of one or several parameters of the spinning conditions, the servicing apparatus then conducts a piecing process in the manner discussed based upon FIGS. 3 and 4, however, without later measuring the yarn twist again.

Figure 8:
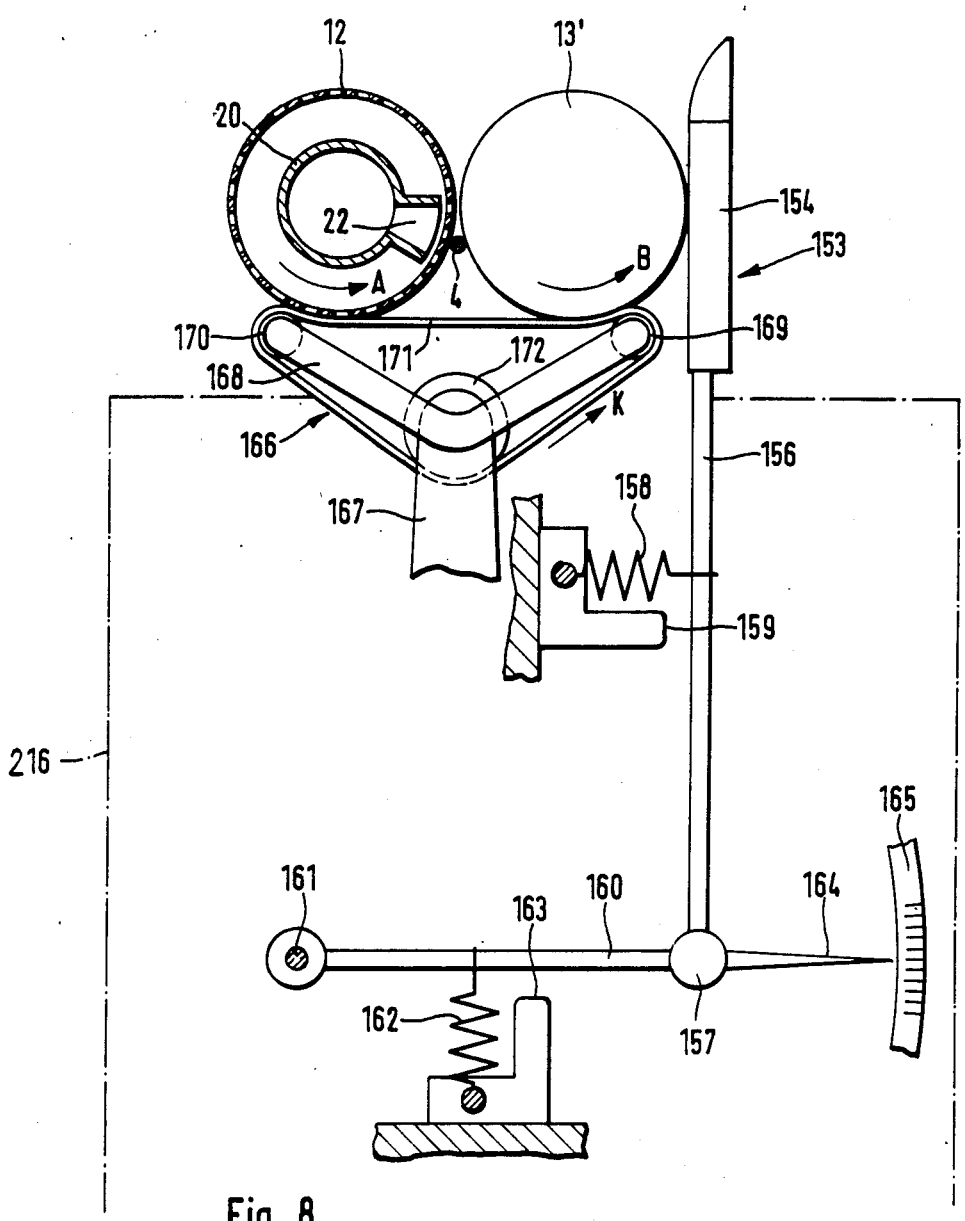
FIG. 8 is a partial schematical view of devices of a movable servicing apparatus for monitoring the friction values in the area of the friction zone and devices for the post-treatment of the friction zone constructed in accordance with certain preferred embodiments of the present invention.

As has been noted above, the servicing apparatus is advantageously equipped with means for checking the actual values of one or several of the parameters of the spinning conditions and inputting these values into the evaluating device. Such an arrangement is described in FIG. 8. In the embodiment according to FIG. 8 and in modification of the embodiment according to FIG. 2, there are provided two different rollers 12 and 13' whereby only one of the rollers rotatating into the wedge-shaped gap (in arrow direction A) is arranged as a suction roller. Therefore, this roller 12 includes a perforated shell and a suction pipe 20 having a suction slot 22. The roller 13', rotating out of the wedge-shaped gap, includes a closed shell surface as is shown in FIG. 8. The servicing apparatus 216 includes a device 153 for monitoring the friction characteristics of a roller 131 having a closed shell surface, a so-called solid roller. Therefore, the device 153 measures the roller 13's existing friction value. This device 153 includes a sliding element 154 which has a top surface made out of a material having a defined friction value with respect to the top surface of roller 13'. This sliding element 154 is arranged upon a lever arm 156 supported via a pivot joint 157 at a lever 160 which is pivotable about an axis 161 of the servicing apparatus 16 against the effect of a tension spring 162. Lever 156 includes a tension spring 158 tensioning the sliding element against the shell surface of roller 13'. The lever 160 is provided with a finger 164 positioned opposite a measuring device shown as a scale 165. The movement of lever 160 against the effect of spring 162 due to the friction effect between the shell surface of roller 13' and the sliding element 154, results in a direct indication of the friction effect of the shell surface of roller 13'.

In the case where the friction effect of roller 13' is determined by the shown device 153 to be insufficient and in fact below a predetermined range, a device 166 of the servicing apparatus 216 is then assigned to the shell surfaces of rollers 12 and 13' for post-treating the friction surfaces (shell surfaces of rollers 12 and 13'). The device 166 includes a lever movable out of the servicing apparatus 216 which carries two deflection rollers 169 and 170 upon a fork 168 surrounded by a band 171 that also surrounds friction roller 172. The friction roller 172 is arranged at lever 167 which is connected, in a not further described manner, to a drive motor. The two deflection rollers 169 and 170 are arranged in such a distance from each other so that the band may easily surround both rollers 12 and 13'. The band 171 which has a fine friction coating is rotatable against the rotational direction of rollers 12 and 13' in arrow direction K whereby the shell surfaces of rollers 12 and 13' are, for example, somewhat roughened or, if necessary, also polished.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method for operating an open-end friction spinning machine of the type having a plurality of spinning units with:

drivable friction surface means defining a yarn formation zone; and feeding means for feeding fibers to the yarn formation zone, said fibers passing through the yarn formation zone along a predetermined path, said process comprising:

monitoring yarn twist of yarn formed at a spinning unit;

comparing the monitored yarn twist with a predetermined desired yarn twist value; and adjusting at least one parameter of spinning conditions in response to deviations from the predetermined desired yarn twist without changing the predetermined path along which the fibers pass through the yarn formation zone.

2. A method as in claim 1, wherein said monitoring includes measuring the yarn twist of the yarn running through and formed in the spinning unit without interrupting operation of the spinning unit.

3. A method as in claim 1, wherein said monitoring includes inserting the yarn of a monitored spinning unit into a movable servicing apparatus and feeding said yarn to a measuring device for measuring said yarn twist.

4. A method as in claim 3, including detecting an actual value of at least one of the parameters of spinning conditions by the servicing apparatus during the monitoring of the yarn twist and prior to adjusting at least one of the parameters of the spinning conditions of the respective spinning unit; and utilizing this actual value in the adjusting.

5. A method as in claim 4, wherein said utilizing includes comparing the detected actual value with predetermined limiting values of the parameters of the spinning conditions taking into account necessary adjustments based upon the monitored yarn twist, and further comprising discontinuing operation of the spinning unit when the limiting values are exceeded indicating an adjustment requirement.

6. A method as in claim 4, wherein said utilizing includes comparing the detected actual value with predetermined limiting values of the parameters of the spinning conditions taking into account necessary adjustments based upon the monitored yarn twist, and further comprising identifying the respective spinning unit requiring the necessary adjustments.

7. A method as in claim 4, wherein said utilizing includes comparing the detected actual value with predetermined limiting values of the parameters of the spinning conditions taking into account necessary adjustments based upon the monitored yarn twist, and wherein said adjusting includes assigning cleaning means for cleaning of the spinning unit particularly in a friction zone when the limiting values are exceeded making an adjustment necessary.

8. A method as in claim 4, wherein said utilizing includes comparing the detected actual value with predetermined limiting values of the parameters of the spinning conditions taking into account necessary adjustments based upon the detected yarn twist, and wherein said adjusting includes assigning post-treatment means for the spinning unit post-treating particularly in a friction zone when limiting values are exceeded making an adjustment necessary.

9. A method as in claim 3, including:

continuing the operation of the spinning unit during measuring by the measuring device;

returning yarn produced during measuring from the servicing apparatus to the spinning unit upon completion of the measurement; and winding this yarn that is returned upon a take-up spool of the spinning unit.

10. A method as in claim 9, including:

detecting an actual value of at least one of the parameters of spinning conditions by the servicing apparatus during the monitoring of the yarn twist and prior to adjusting at least one of the parameters of the spinning conditions of the respective spinning units; and utilizing this actual value in the adjusting.

11. A method as in claim 10, wherein said utilizing includes comparing the detected actual value with predetermined limiting value of the parameters of the spinning conditions taking into account necessary adjustments based upon the monitored yarn twist, and further comprising discontinuing operation of the spinning unit when the limiting values are exceeded indicating an adjustment requirement.

12. A method as in claim 10, wherein said utilizing includes comparing the detected actual value with predetermined limiting value of the parameters of the spinning conditions taking into account necessary adjustments based upon the monitored yarn twist, and further comprising identifying the respective spinning unit requiring the necessary adjustments.

13. A method as in claim 10, wherein said utilizing includes comparing the detected actual value with predetermined limiting values of the parameters of the spinning conditions taking into account necessary adjustments based upon the detected yarn twist, and wherein said adjusting includes assigning cleaning means for cleaning of the spinning unit particularly in a friction zone when the limiting values are exceeded making an adjustment necessary.

14. A method as in claim 10, wherein said utilizing includes comparing the detected actual value with predetermined limiting values of the parameters of the spinning conditions taking into account necessary adjustments based upon the detected yarn twist, and wherein said adjusting includes assigning post-treatment means for the spinning unit post-treating particularly in a friction zone when the limiting values are exceeded making an adjustment necessary.

15. A method as in claim 3, including switching off the spinning unit following the insertion of the yarn into the servicing apparatus, and resuming the spinning unit operation upon removal of a yarn test sample.

16. A method as in claim 3, including gathering a yarn sample from a take-up spool of a switched off spinning unit for measuring the yarn twist.

17. A method as in claim 16, wherein said gathering of a yarn sample off the take-up spool of a spinning unit is conducted during one of the following, a piecing process and a doffing process, at the respective associated spinning unit.

18. A method as in claim 3, wherein said monitoring includes mechanically analyzing said yarn twist.

19. A method as in claim 3, wherein said monitoring includes optically analyzing said yarn twist.

20. An open-end friction spinning machine with a plurality of spinning units comprising:

drivable friction surface means defining a yarn formation zone;

feeding means for feeding fibers to the yarn formation zone, said fibers passing through the yarn formation zone along a predetermined path;

monitoring means for monitoring yarn twist of yarn at the spinning units;

comparing means for comparing the monitored yarn twist with a predetermined desired yarn twist value; and adjusting means for adjusting at least one parameter of spinning conditions in response to deviations from the predetermined desired yarn twist value without changing the predetermined path along which the fibers pass through the yarn formation zone.

21. An apparatus as in claim 20, wherein said monitoring means is provided at a movable servicing means which includes means for receiving the yarn to be monitored and which is selectively movable to respective areas of the spinning units.

22. A method for operating an open-end friction spinning machine of the type having a plurality of spinning units with:

drivable friction surface means defining a yarn formation zone; and feeding means for feeding fibers to the yarn formation zone, said process comprising:

monitoring yarn twist of yarn formed at a spinning unit;

comparing the monitored yarn twist with a predetermined desired yarn twist value; and adjusting at least one parameter of spinning conditions in response to deviations from the predetermined desired yarn twist without changing the positioning of the drivable friction surface means defining the yarn formation zone.

23. A method as in claim 1, wherein said monitoring of the yarn twist includes monitoring a cross-section of the yarn.

24. A method as in claim 23, wherein said monitoring of the yarn twist further includes determining a value of the number of fibers in the yarn.

25. An apparatus as in claim 20, wherein said monitoring means includes means for monitoring the cross-section of the yarn.

26. An apparatus as in claim 25, wherein said monitoring means further includes means for determining a value of the number of fibers in the yarn.

* * * * *